US007794176B2

(12) United States Patent
Musser

(10) Patent No.: US 7,794,176 B2
(45) Date of Patent: Sep. 14, 2010

(54) HEIGHT ADJUSTABLE WATER CONTROL CONDUCT

(75) Inventor: Darell W. Musser, Arlington, TX (US)

(73) Assignee: Stegmeier LLC, Arlington, TX (US)

( * ) Notice: Subject to any disclaimer, the term of this patent is extended or adjusted under 35 U.S.C. 154(b) by 311 days.

(21) Appl. No.: 12/079,331

(22) Filed: Mar. 25, 2008

(65) Prior Publication Data

US 2009/0241440 A1 Oct. 1, 2009

(51) Int. Cl.
*E01C 11/22* (2006.01)
*E04H 4/00* (2006.01)

(52) U.S. Cl. ..... 405/118; 405/43; 405/127; 404/4; 52/302.3; D23/261; D23/267

(58) Field of Classification Search ..... 405/36, 405/43, 118, 124–127; D23/261–267; 404/2–5; 52/11, 12, 302.3
See application file for complete search history.

(56) References Cited

U.S. PATENT DOCUMENTS 4,365,911 A * 12/1982 Rossberg ..... 405/43
4,815,888 A * 3/1989 Stegmeier ..... 404/4
5,211,461 A * 5/1993 Teufel et al. ..... 312/334.4
5,380,121 A * 1/1995 Schluter ..... 404/14
5,454,663 A * 10/1995 Stegmeier ..... 404/2
5,784,838 A * 7/1998 Phillips ..... 52/169.5
D466,596 S * 12/2002 Stegmeier et al. ..... D23/267
6,729,795 B2 * 5/2004 Dahowski et al. ..... 404/4

* cited by examiner

*Primary Examiner*—Tara Mayo-Pinnock

(57) ABSTRACT

An adjustable height drain has an elongate base element and an elongate drain element. The elongate base element has walls extending upwardly from the elongate base element. The elongate drain element has a top surface supported by downwardly extending walls, and the top surface has a plurality of apertures enabling water to drain through the top surface. First interlocking elements are vertically spaced from each other on the upwardly extending walls, and second interlocking elements are spaced apart from each other on the downwardly extending walls, enabling the elongate drain element to engage the elongate base element in either a first position or a second position, adapting to change in surface elevation.

19 Claims, 18 Drawing Sheets

HEIGHT ADJUSTABLE WATER CONTROL CONDUCT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates generally to a water control conduit (i.e. drain and drain systems) adapted for installation in surfaces requiring water dispersal, and more particularly to a water dispersing conduit that is capable of being adjustable in height relative to a surrounding surface elevation. Rainfall, irrigation, spillage from a pool or fountain, or pressure-cleaning of a walk way or access way surface, such as a patio, sidewalk or driveway, results in deleterious pooling of water. Pooled water can create slip hazards and if allowed to remain for protracted periods, can result in loss of integrity in the surface's structure and propagation of molds, mildew, bacteria and insects. It is therefore desirable to include into a surface exposed to possible water pooling a dispersing conduit which allows for removal of water from the surface and to an area where it may be better managed (i.e. sidewalk gutter, storm drain, irrigation return).

Water dispersing conduits used to facilitate drainage from cementitious decking are known in the art. U.S. Pat. No. 4,815,888 to Stegmeier, hereby incorporated by reference in full, teaches a drain used to facilitate drainage from swimming pool decking through the use of polymer plastic drain device. The drain is comprised of an elongated channel placed within the cementitious matrix and the drain is formed of a bottom wall and parallel spaced apart upright sidewalls terminating at their upper distal ends in a grate retaining profile. Adapted to overlie the channel is an elongated apertured grating having continuous skirts downwardly depending from the longitudinal edges thereof. The skirts are inserted within the retaining profile of the channel in a combined friction and spring action enabling the grating to be removed and replaced as desired.

U.S. Pat. No. 6,729,795 to Dahowski, et al., is directed to a drainage conduit having a channel with longitudinal grooves formed in the profile of the channel walls. A separate grating top having longitudinal skirts with a similar groove profile to the channel walls is slid over and into the grooves of the channel to maintain the grating top and channel in appropriate relation. The grating top and channel grooves exhibit a single mating surface, and thereby the top and channel attain a singular relation to one another.

Both of the cited prior art teach to water control conduits having the ability to exhibit a single total height as measured relative to the top of the grating and to the base of the channel. A single height water control conduit is problematic, particularly where a surface elevation either changes or transitions from a first surface substrate to a second surface substrate. German Published Patent Application 202005007662 to Schneider and Austrian Patent No. 500204 both attempt to address this issue by use of a third device between the channel and the grate such that the total height of the drain can be altered between two different heights.

A further problematic issue in water control and drainage exists when the walk way or access way is refurbished with an overlay of individual units such as bricks, pavers or stone. Such individual units are typically placed over an existing durable surface and thus precludes the actual embedding of a drainage conduit channel into the durable surface directly. To address this issue, attempts have been made to add retention elements to the base of the drainage channel to prevent the drain from displacing out of the new surface comprised of individual units. Particularly practiced embodiments of such retention elements include flanges which extend out and away from the base and under the adjacent individual units. The use of a flange type extension has met with limited success as the added height imposed by the flange under the individual unit causes the edge of the unit directly adjacent to the drain to rise, creating an elevation increase which prevents complete evacuation of the water and a number of angle induced voids around that individual unit.

There remains an unmet need for a water control conduit that is adjustable in height so that the drain may be used with same or differing surface elevations, is easy to adjust in height without special tools or skills, does not include additional pieces and is suitable for use with a diverse variety of walk way and access way surfaces for the dispersal of water.

SUMMARY OF THE INVENTION

The present invention is directed to an adjustable height drain that includes an elongate base element and an elongate drain element. The elongate base element has side walls extending upwardly from the elongate base element to form a longitudinal channel. The elongate drain element has a top surface supported by downwardly extending walls, the top surface having a plurality of apertures enabling water to drain through the top surface. A plurality of first interlocking elements are vertically spaced from each other on the upwardly extending channel walls. A plurality of second interlocking elements are vertically spaced apart from each other on the downwardly extending drain walls. By selecting which first interlocking elements and which second interlocking elements are engaged, the total height of the drain top to the drain base can be readily adjusted.

A primary objective of the present invention is to provide an adjustable height drain which can be readily adjusted in the field prior to being installed. At the time the adjustable height drain is to be installed, the user evaluates changes in elevation which might exist at given points along the intended path of the drain relative to such variables as the thickness of the surface and transitioning from a first surface to a second surface. The user is then able to employ a single set of elongate base elements with a single set of elongate drain elements to achieve a water control conduit adapted to a wide variance in surface elevations.

The invention further includes optional use of differing cross sectional profiles in the elongate base element. The cross sectional profiles of the base element include components which act upon the water to be conveyed and/or the retention of the base element in a surface, wherein the components themselves may be straight, angled, radiused, or combinations thereof. Components relative to the conveyance of water may be selected so that optimal flow characteristics with reduced potential of occlusion buildup are achieved. The base elements components which act upon the surrounding environment may be selected to as to prevent the drain assembly from displacing out of the intended position.

A further embodiment of the present invention is the incorporation of drain retention profiles in the outer aspect of the upward extending channel walls. The drain retention profiles include such geometries as will allow the drain to adapt to the environment created to either side of the elongate channel and prevent the drain assembly from displacing out of the intended position relative to the adjacent surface.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The invention will be more easily understood by a detailed explanation of the invention including drawings. Accordingly, drawings which are particularly suited for explaining the inventions are attached herewith; however, it should be understood that such drawings are for descriptive purposes only and as thus are not necessarily to scale beyond the measurements provided. The drawings are briefly described as follows.

DETAILED DESCRIPTION OF THE INVENTION

Figure 1:
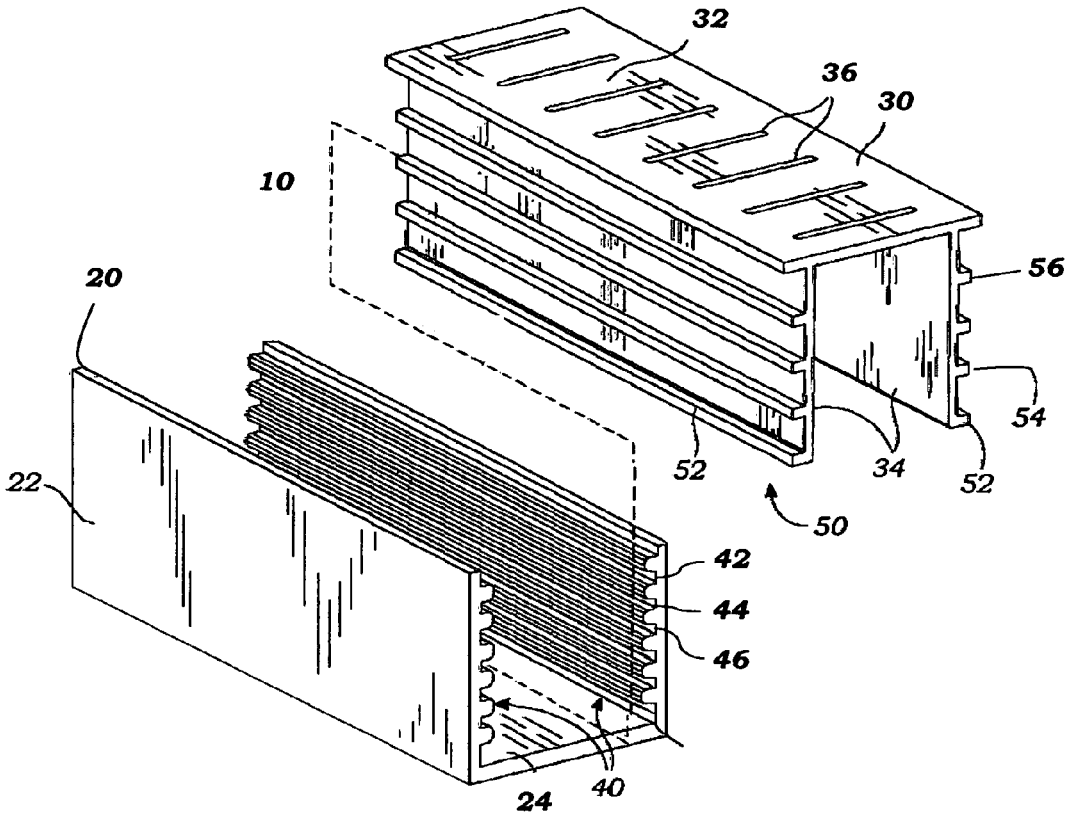
FIG. 1 is an exploded perspective view of an adjustable height drain having a plurality of first and second interlocking elements according to a preferred embodiment of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

FIGS. 1 through 18 illustrate the present invention. Turning specifically to FIG. 1, therein is depicted an adjustable height drain 10 that is adapted to be adjusted for use with multiple or changing surface elevations. Adjustable height drain 10 includes an elongate base element 20 and an elongate drain element 30. Elongate base element 20 includes walls 22 extending upwardly from elongate base element 20. The upwardly extending walls 22 are preferably parallel, continuous and laterally spaced from one another by a defined distance, although those skilled in the art may devise alternative embodiments that are not so structured. In practical applications such as typical walk way and access way surfaces, the distance between upwardly extending walls 22 is within the range of 1 inch to 12 inches, preferably in the range of 1.25 inches and 8 inches, and most preferably in the range of 1.5 inches and 6 inches. The elongate base element 20 and the upwardly extending walls 22, together, define a water drainage channel 24 having a channel width approximate to the distance of walls 22.

Water drainage channel 24 may have a cross-sectional profile that is straight, angled, radiused or combinations thereof. Cross-sectional profiles of water drainage channel 24 may be selected to so as to enhance flow characteristics, such as with a rounded contour (FIG. 18) or a "V" shaped contour (not shown). Alternate elements can be included which further reduce creation of eddy currents that can lead to sitting and occlusion and/or which provide living hinge points to resist compression induced failure and cracking of the channel.

The elongate drain element 30 has a top surface 32 supported by downwardly extending walls 34. Top surface 32 includes a plurality of apertures 36 enabling water to drain through the top surface 32 and into the water drainage channel 24. Optionally, top surface 32 may further include longitudinal grooves or recesses to enhance the functional (e.g. flow) performance of apertures 36. The downwardly extending walls 34 are preferably parallel to and laterally spaced from one another, similar to the upwardly extending walls 22.

Upwardly extending walls 22 include first interlocking elements 40 vertically spaced from each other, and downwardly extending walls 34 include second interlocking elements 50 spaced apart from each other. The elongate drain element 30 is adapted to engage the elongate base element 20 via at least one longitudinal slot defined in first interlocking elements 40 and at least one longitudinal flange defined by second interlocking elements 50. At a minimum requirement for attaining an adjustable height drain 10, there must be at least one longitudinal slot in first interlocking element 40 and two longitudinal flanges in second interlocking elements 50 or two longitudinal slots in first interlocking elements 40 and one longitudinal flange in second interlocking element 50. As depicted in the representative embodiment in FIG. 1, first interlocking elements 40 include first, second, and third longitudinal slots 42, 44, and 46 that are vertically spaced from one another. In this embodiment, the second interlocking elements 50 include first, second and third longitudinal flanges 52, 54, and 56 that are similarly vertically spaced from one another.

The adjustable height drain 10 is adapted for a first surface elevation having a first thickness, T(sub)1, as well as subsequent thickness, T(sub)N, dependent upon which interlocking slots and flanges are chosen to be slidably engaged. The maximum thickness, T(sub)MAX, that the adjustable height drain 10 can obtain is defined by the lowest, or the furthest from the top surface 32, first interlocking element 40 of the elongate drain element 30 being slidably engaged in the highest, or furthest from base element 20, second interlocking element 50. As shown in FIGS. 8 through 14, the minimum thickness that the adjustable height drain 10 can attain is modified by break lines 27 positioned in the first interlocking elements 40 and break lines 29 in second interlocking elements 50. For the optional reduction of the minimum height capability of the adjustable height drain, respective interlocking elements are accessed after convenient removal of excess or extraneous locking elements at break lines 27 and 29 to attain the lowest possible height, T(sub)MIN of the adjustable height drain assembly.

The first interlocking elements 40 and the second interlocking elements 50 may be a wide range of physical structures that enable the elongate base element 20 to engage the elongate drain element 30 in two different locations, and the terms first interlocking elements 40 and second interlocking elements 50 are hereby defined to include any structure or structures that perform these functions. The flange and slots may be reversed, for example, or there may be one flange or slot in alternating pattern, or any number of flanges or slots. Furthermore, the flanges could be provided by other structures of different shape, and the slots could be various forms of apertures or locking elements. As the use of the interlocking regions 40 and 50 are a critical element of the functionality associated with the adjustable height drain, and not the profiles associated with the interlocking regions themselves, any alternative structures associated with the interlocking regions should be considered within the scope of the present invention.

Both elongate base element 20 and elongate drain element 30 may be produced using standard forming techniques known in the art, which include but are not limited to extrusion molding, compression molding, stamping, and casting. The elongate base element 20 and elongate drain element 30 are preferably formed of compositions such as plastic polymers and blends, metals and metal alloys, or any other material or combination of materials suitable for the construction of adjustable height drain 10. The composition may include performance and/or aesthetic modifying chemistries. The materials should be strong enough to not break under ordinary strains (e.g. torsion load, flexural load, static load), and durable enough to withstand environmental effects (e.g. freeze/thaw, high temperature) for prolonged periods of time. The elongate base element 20 and elongate drain element 30 may be formed from the same or different compositions. Selection of a suitable composition is also dependent upon the intended application, for example the composition used in fabrication of elongate base element 20 wherein the drain is being installed in high temperature bitumen should utilize a material capable of resisting prolonged exposure to oil and elevated temperature. In the alternative, a suitable composition for elongate base element 20 wherein the drain is being installed is cementitious based matrix; a material capable of exposure to strong alkali is desirable. The elongate drain element 30 in particular should be capable of withstanding considerable exposure to solar radiation.

Figure 2:
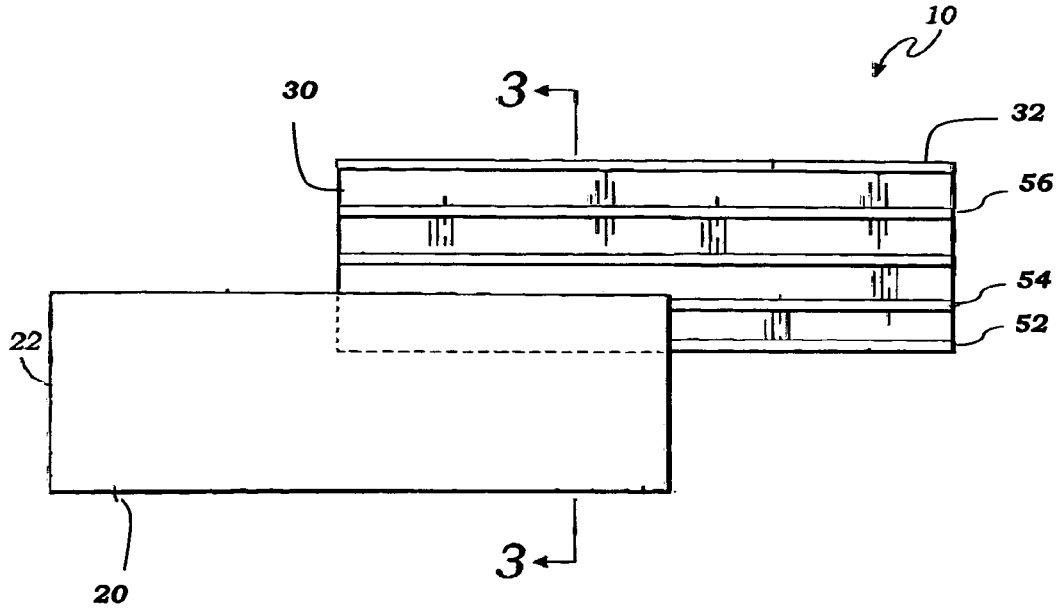
FIG. 2 is a left side view of an elongate base element slidably engaging an elongate drain element at a highest possible height position, T(sub)MAX.
Figure 3:
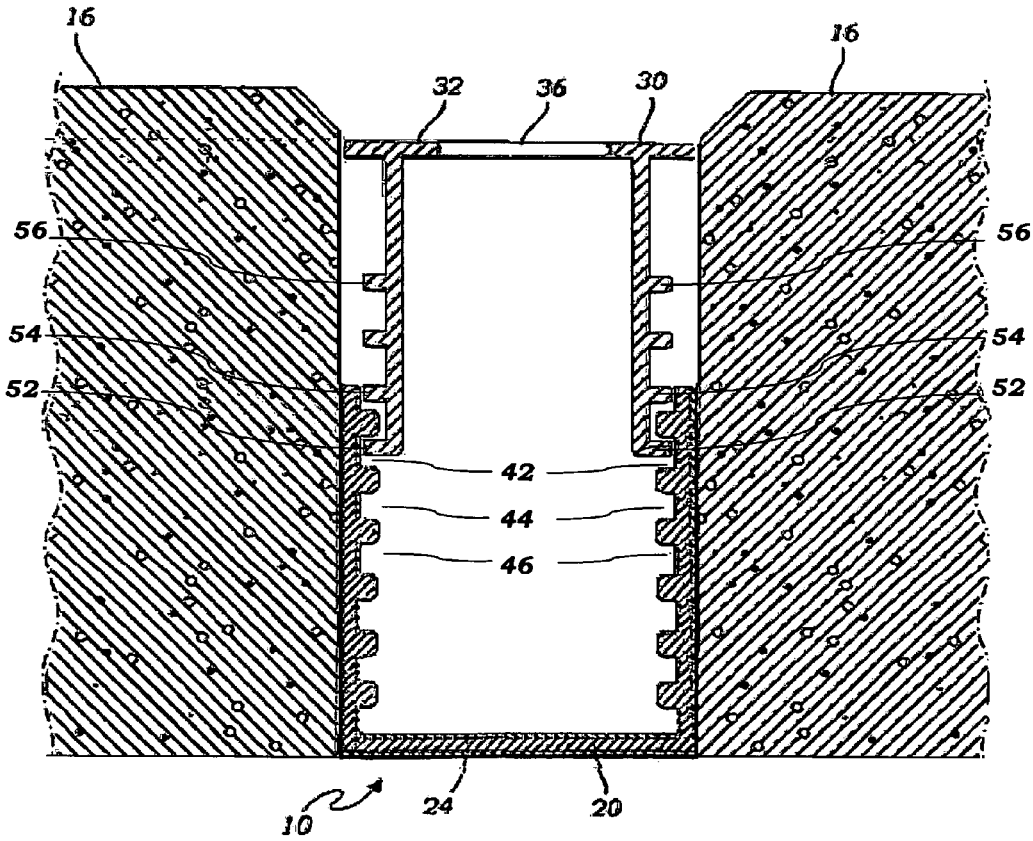
FIG. 3 is a cross-sectional view thereof taken along line 3-3 in FIG. 2, further illustrating a representative adjustable height drain set at the highest possible setting and interacting with a surface having a maximum elevation.
Figure 4:
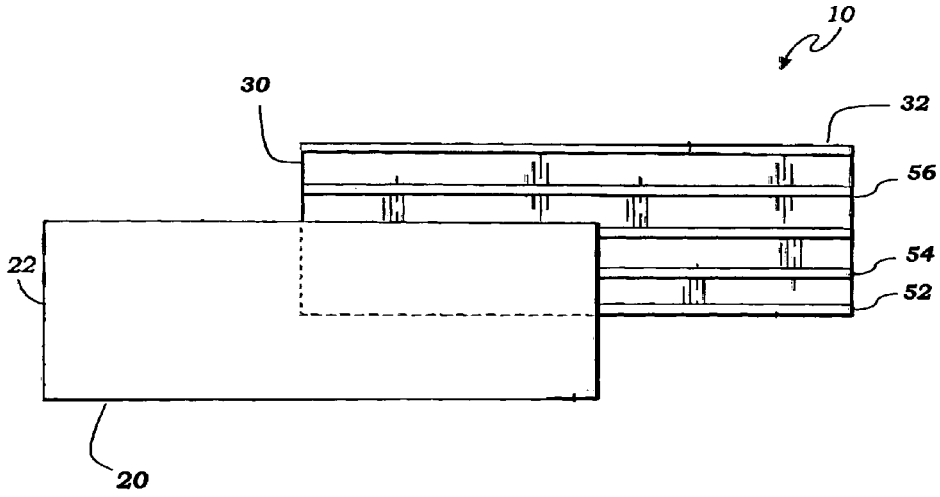
FIG. 4 is a left side view of an elongate base element slidably engaging an elongate drain element in a second selected position.
Figure 5:
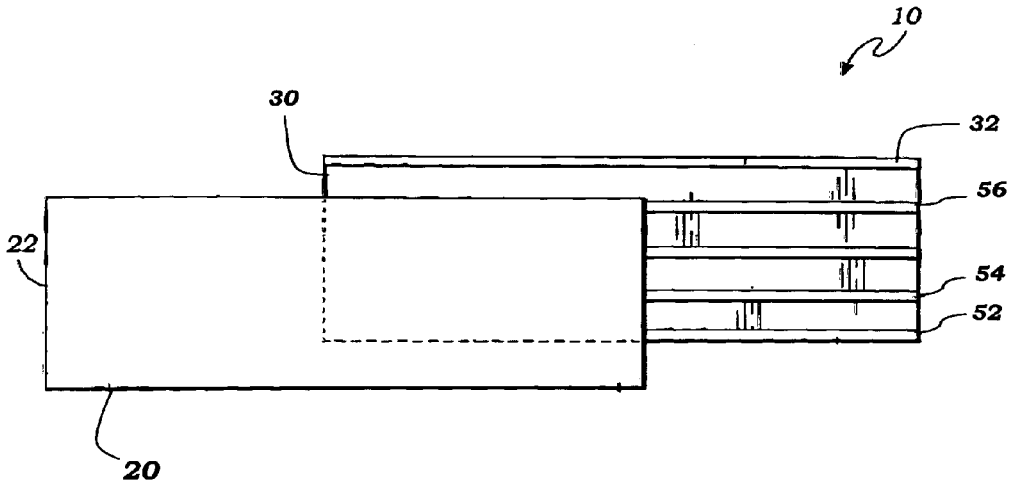
FIG. 5 is a left side view of an elongate base element slidably engaging an elongate drain element in a third selected position.
Figure 6:
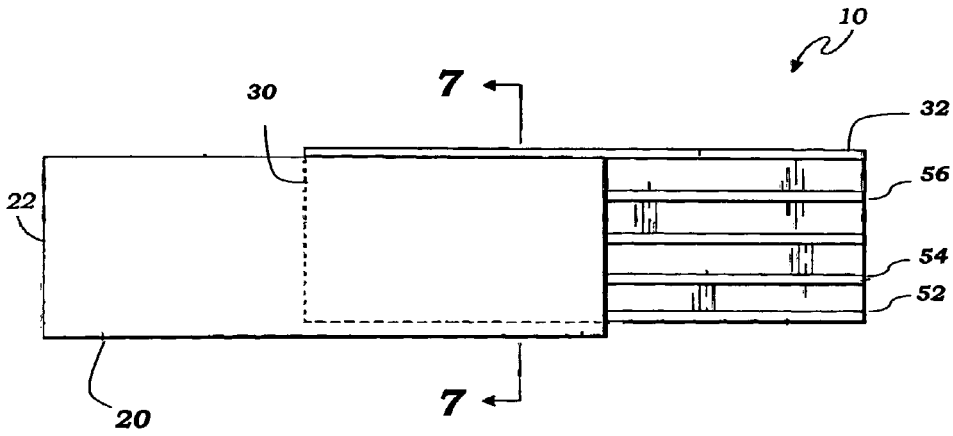
FIG. 6 is a left side view of an elongate base element slidably engaging an elongate drain element in a fourth or lowest standard selected position.
Figure 7:
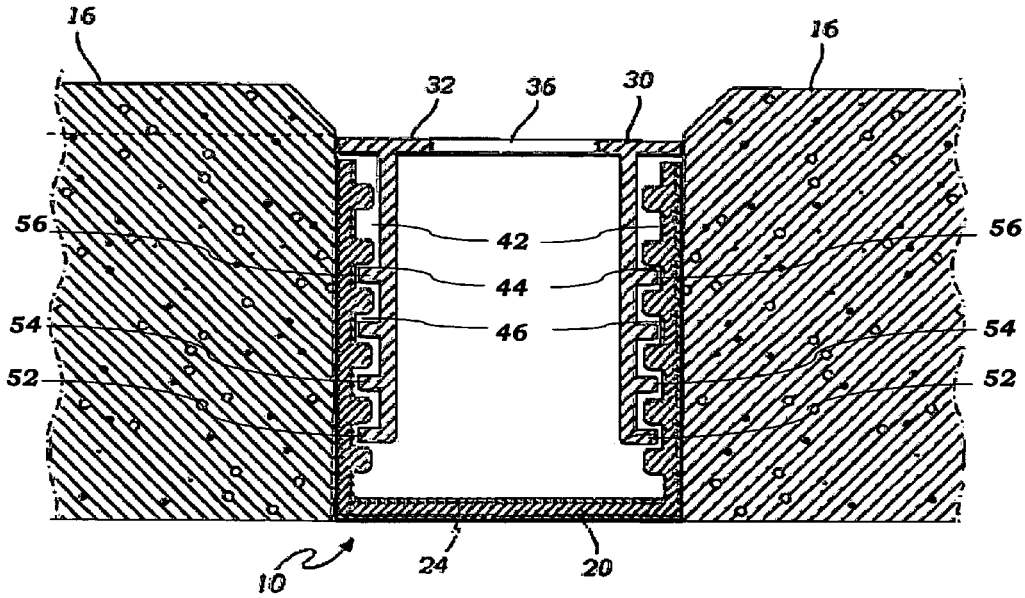
FIG. 7 is a cross-sectional view thereof taken along line 7-7 in FIG. 6, further illustrating a representative adjustable height drain set at the lowest standard setting and interacting with a surface having a reduced elevation.
Figure 8:
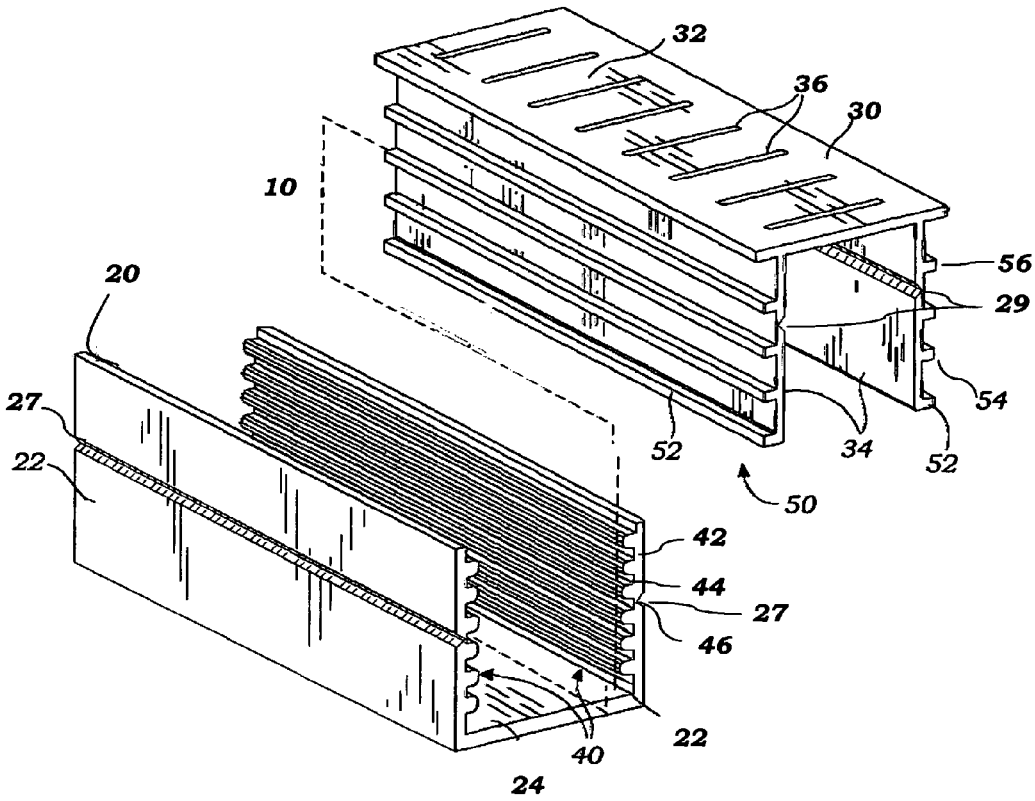
FIG. 8 is an exploded perspective view of an adjustable height drain having a plurality of first and second interlocking elements according to a preferred embodiment of the present invention, further including break lines positioned in the first and second interlocking elements for the optional reduction of the minimum height capability of the adjustable height drain.
Figure 9:
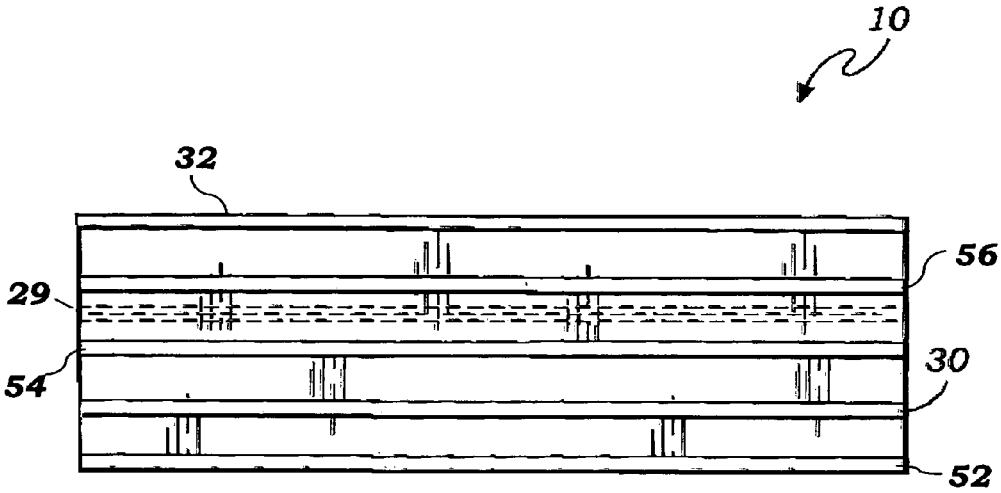
FIG. 9 is a left side view of an elongate drain element having a predefined break line positioned between the first and second individual flanges of the second interlocking elements.
Figure 10:
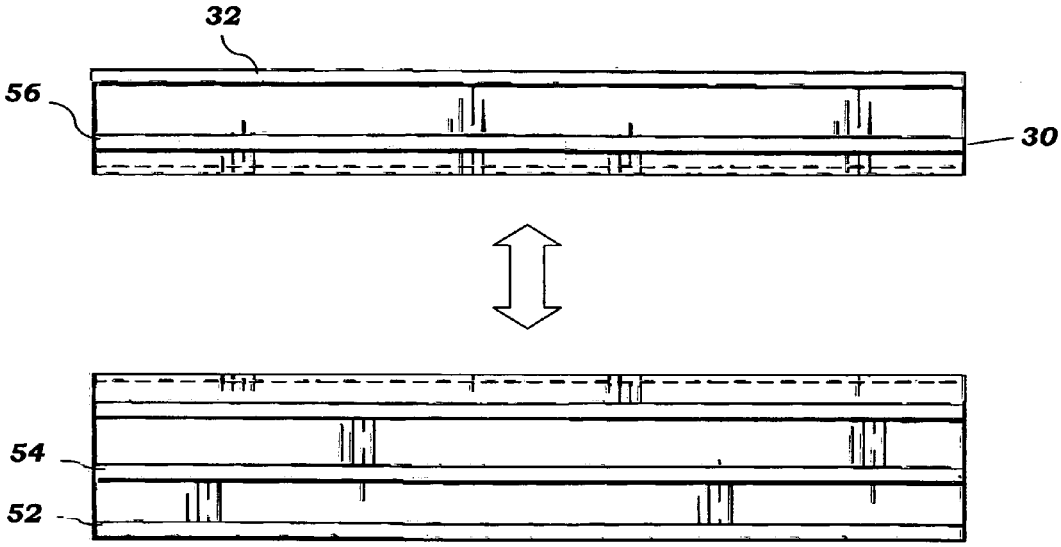
FIG. 10 is a left side view of an elongate drain element having a predefined break line positioned between the first and second individual flanges of the second interlocking elements wherein the break line has been utilized to separate the lower section away from the elongate drain element.
Figure 11:
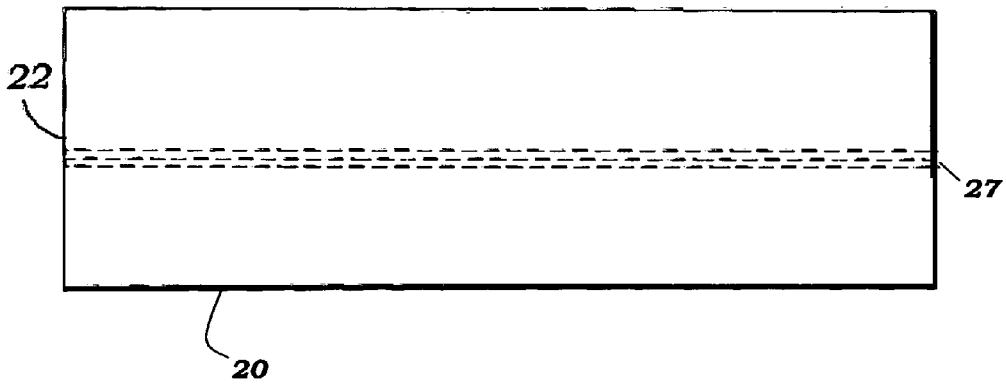
FIG. 11 is a left side view of an elongate base element having a predefined break line positioned between the third and forth individual slots of the first interlocking elements.
Figure 12:
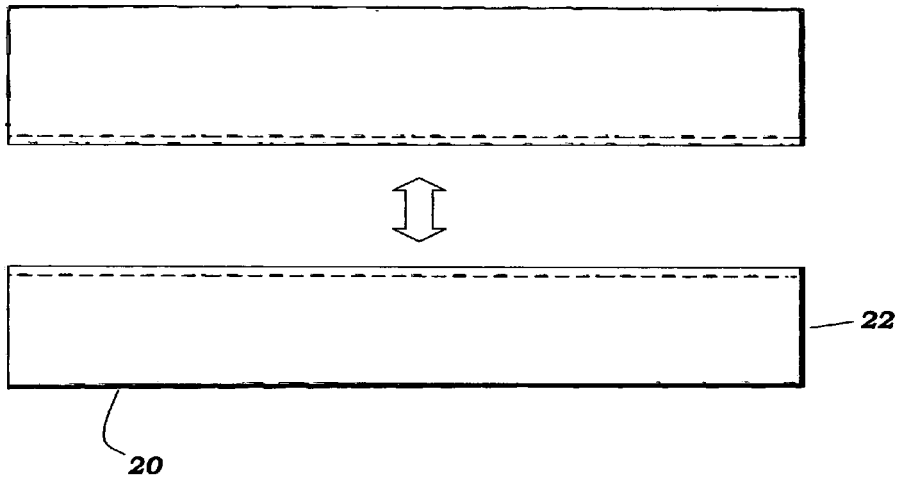
FIG. 12 is a left side view of an elongate base element having a predefined break line positioned between the third and forth individual slots of the first interlocking elements wherein the break line has been utilized to separate the upper section away from the elongate base element.
Figure 13:
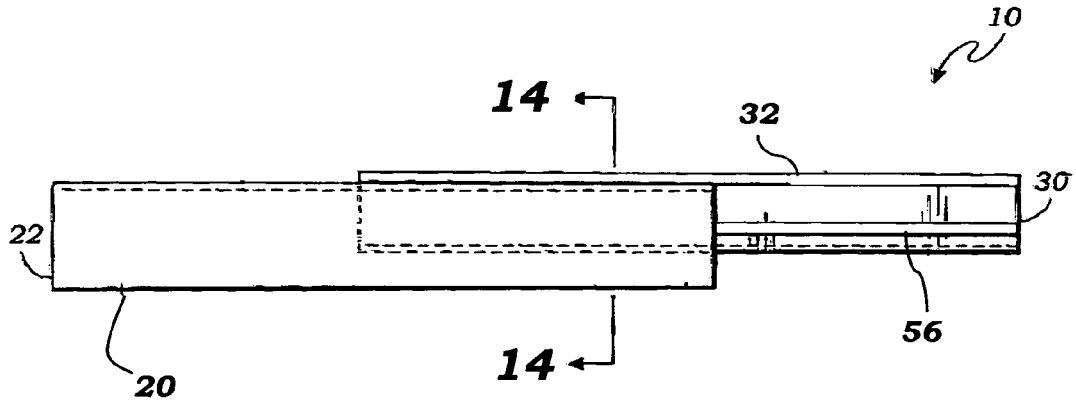
FIG. 13 is a left side view of an elongate base element depicted in FIG. 12 slidably engaging an elongate drain element depicted in FIG. 10 wherein the respective interlocking elements are accessed after convenient removal of excess or extraneous locking elements to attain a lowest possible height, T(sub)MIN of the adjustable height drain assembly.
Figure 14:
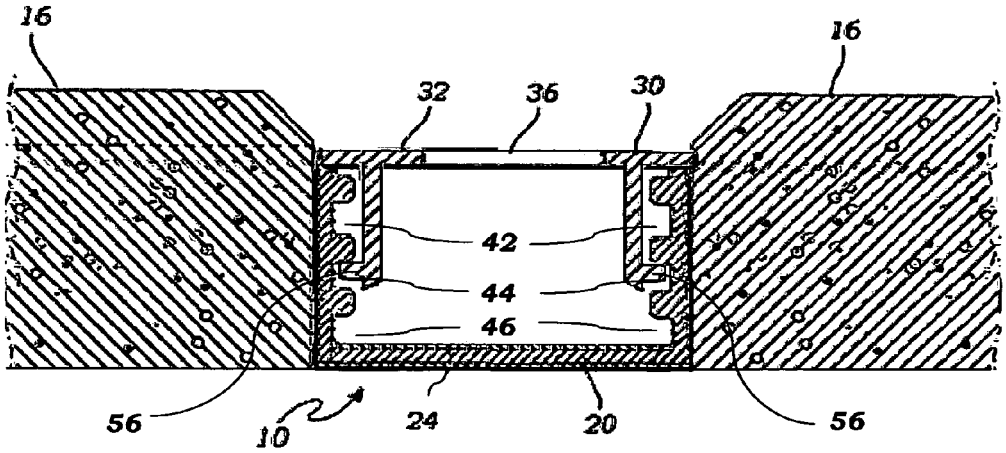
FIG. 14 is a cross-sectional view thereof taken along line 14-14 in FIG. 13, is an exploded perspective view of an adjustable height drain having a plurality of first and second interlocking elements accessed through removal of excess or extraneous locking elements through activation of predefined break lines, interacting with a surface having a minimum elevation.
Figure 15:
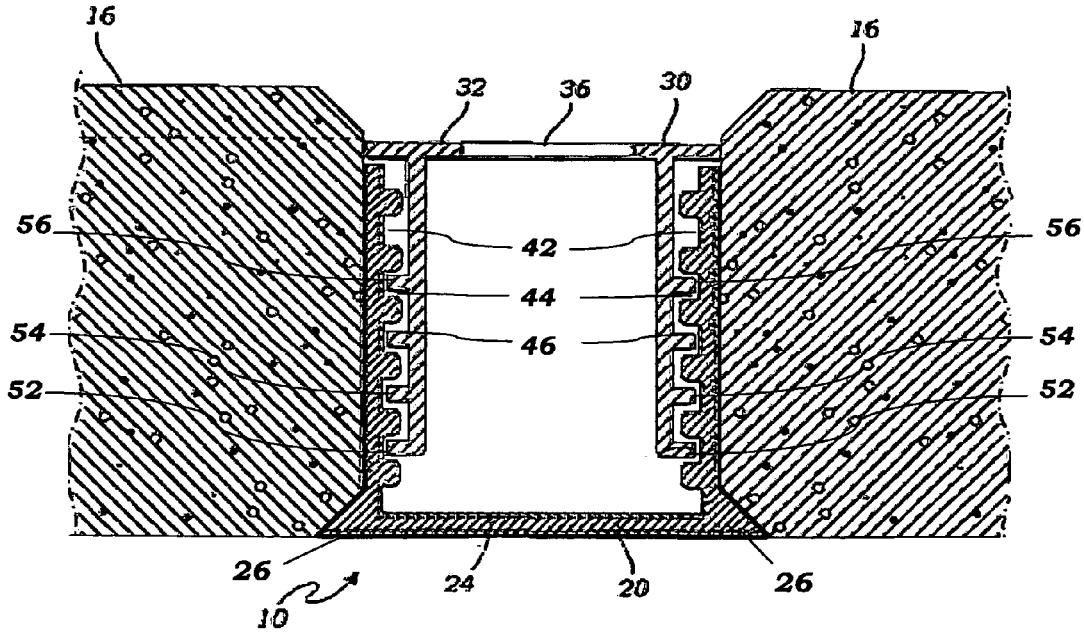
FIG. 15 is a cross-sectional view of a drain as depicted in FIG. 2, further illustrating a representative optional channel base retention profile interacting with individual units to prevent drain assembly displacement.
Figure 16:
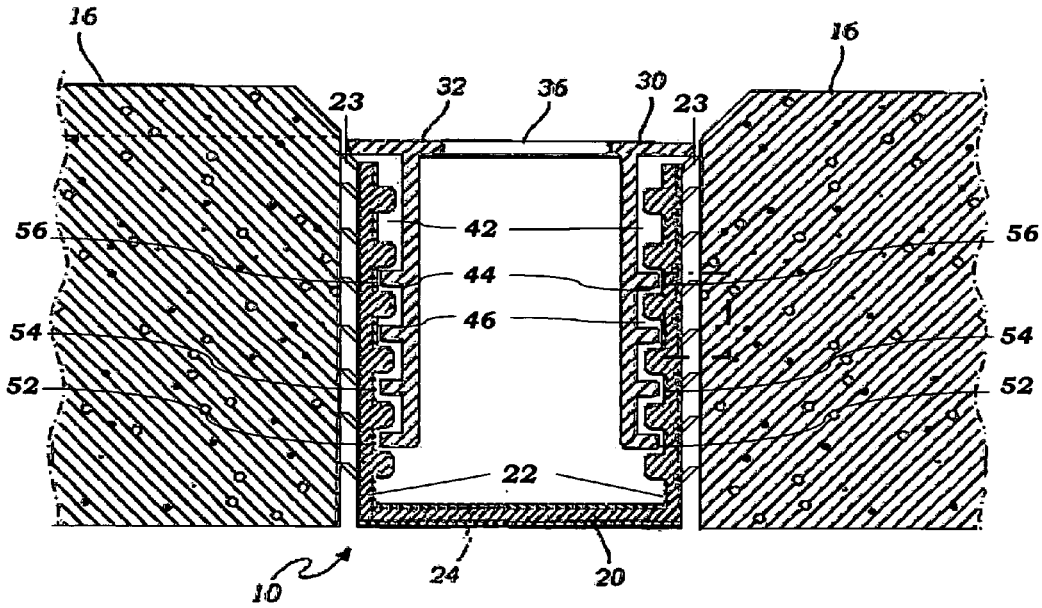
FIG. 16 is a cross-sectional view of a drain as depicted in FIG. 2, further illustrating a representative optional channel wall retention profile interacting with individual units to prevent drain assembly displacement.
Figure 17:
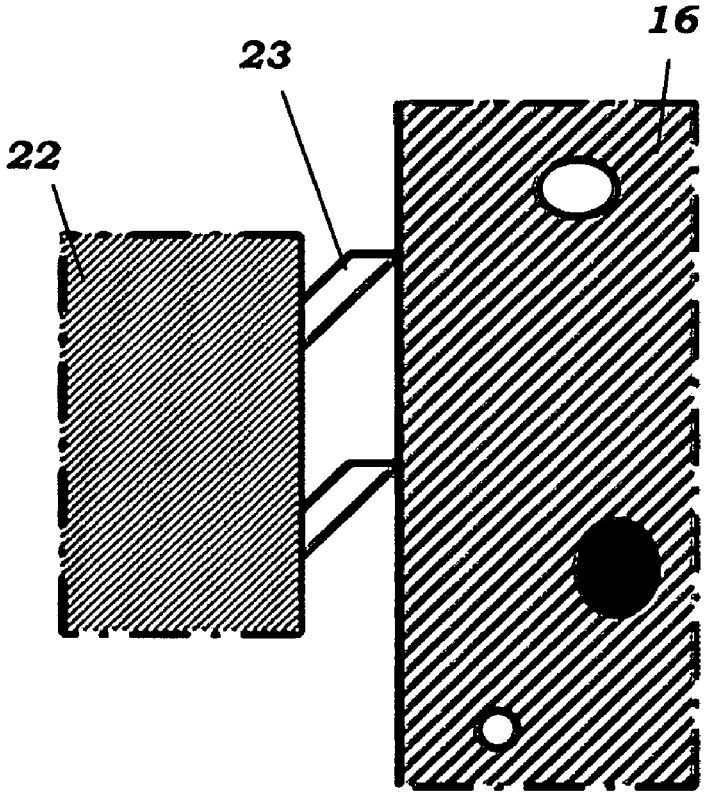
FIG. 17 is a magnified view of channel wall retention profile taken along section 17-17 showing anchoring action by the individual profile elements upon adjacent individual units.
Figure 18:
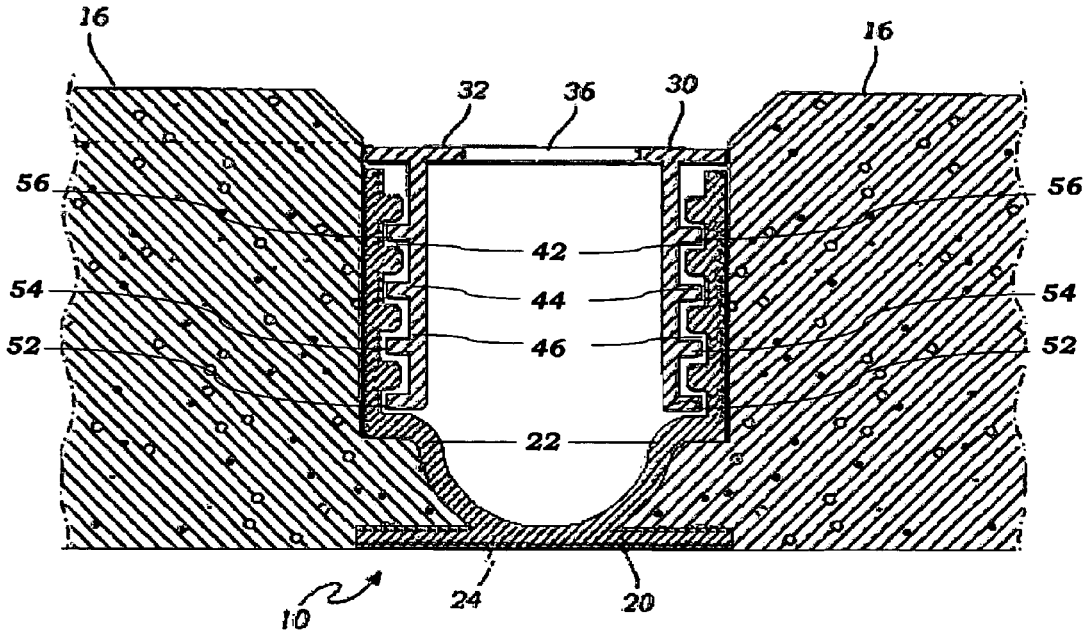
FIG. 18 is a cross-sectional view of a drain as depicted in FIG. 2, further illustrating a representative optional an elongate base element having a flow enhancing rounded channel.

In an optional embodiment, the adjustable height drain 10 further includes means for retaining the drain channel within the intended surface substrate. To attain such retention of the drain channel, elongate base element 20, upwardly extending channel walls 22 or a combination of elongate base element 20 and upwardly extending channel walls 22 may include retention profiles. FIG. 15 show elongate base element 20 including optional outwardly extending base flanges 26 extending from the elongate base element 20. The base flanges 26 form a generally planar anchoring structure adapted to fit up to and against a lower aspect surface 16 adjacent the adjustable height drain 10. FIGS. 16 and 17 show upwardly extending channel walls 22 having optional outwardly extending retention flanges 23. The retention flanges 23 are adapted to fit up to and against the side of surface 16 adjacent the adjustable height drain 10. FIG. 18 show a water drainage channel 24 having a rounded profile. The rounded profile causes channel walls 22 to displace inwardly before meeting drainage channel 24 within elongate base element 20. This displacement of the channel walls creates a recess FIG. 4 is a left side view of the elongate base element 20 slidably engaging the elongate drain element 30 in a first position T(sub)1. FIG. 5 is a left side view of the elongate base element 20 slidably engaging the elongate drain element 30 in a second position wherein the total height is decreased by one increment to T(sub)2. FIG. 2 is a left side view of the elongate base element 20 slidably engaging the elongate drain element 30 in a third position wherein the total height is further increased to a maximum height T(sub)MAX. FIGS. 8 through 12 depict inclusion of an optional break line 27. In FIGS. 9 and 10 elongate base element 20 has been altered through optional removal of a portion of channel walls 22 along break line 27. In FIGS. 11 and 12 elongate drain element 30 has been altered through optional removal of a portion of drain walls 34 along break line 29. FIG. 13 shows the shortened elongate base element 20 slidably engaging the elongate drain element 30 in a minimum position wherein the total height is at T(sub)MIN.

As disclosed, the adjustable height drain 10 is applicable to direct incorporation into cementitious matrix at the time the cementitious matrix is placed as well as applications wherein the drain is set against a previously cast and cured cementitious matrix and new cementitious matrix is applied to only one side of the drain. The instant invention is also imminently suitable for refurbishment of a surface that require water drainage and individual units are being overlaid on the pre-existing surface to form a new, raise surface. Individual units include materials used to construct a new surface and for purposes of this application, the term "individual unit" is hereby expressly defined to include any form of decking constructed of any materials, including but not limited to stone, concrete, brick, wood, synthetic material, or any other form of material or style of decking that may be suitable for use with the described adjustable height drain 10.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. An adjustable height drain comprising:

a. an elongate base element having walls extending upwardly from said elongate base element to form an interior water conducting channel;

b. a plurality of interlocking elements vertically spaced from each other on said upwardly extending walls;

c. an elongate drain element having a top surface supported by downwardly extending walls, said top surface having a plurality of apertures enabling water to drain through said top surface;

d. a plurality of interlocking elements vertically spaced from each other on said downwardly extending walls, wherein said elongate drain element comprising interlocking elements upon said downwardly extending walls is engaged upon said elongate base element via said interlocking elements depending from said upwardly extending walls such that said top surface of said elongate drain element is vertically spaced from said elongate base element by a first distance T(sub)1; and wherein said elongate drain element and said elongate base element may be subsequently disengaged and said first distance T(sub)1 adjusted to a second distance T(sub)N by altering which interlocking elements upon said downwardly extending walls of said elongate drain element are engaged upon said interlocking elements depending from said upwardly extending walls of said elongate base element.

2. The adjustable height drain of claim 1, further comprising outwardly extending retention elements.

3. The adjustable height drain of claim 2, wherein said retention elements are retention profiles extending from said channel walls and away from said interior water conducting channel.

4. The adjustable height drain of claim 2, wherein said retention elements are retention components extending from said elongate base element.

5. The adjustable height drain of claim 2, wherein said retention elements are retention profiles extending from said channel walls and away from said interior water conducting channel.

6. The adjustable height drain of claim 2, wherein said retention elements are retention components extending from said elongate base element.

7. The adjustable height drain of claim 1, wherein the upwardly extending walls are parallel to and are laterally spaced from one another.

8. The adjustable height drain of claim 1, wherein the first interlocking elements are a plurality of longitudinal slots in the upwardly extending walls that extend the length of the elongate base element, and wherein the second interlocking elements are a plurality of longitudinal flanges extending from the downwardly extending walls, wherein one or more of said longitudinal slots are adapted to slidably engage one or more selected longitudinal flanges.

9. The adjustable height drain of claim 1, wherein at least one break line is included within first interlocking elements wherein the height of the upwardly extending walls can be reduced to a predefined level.

10. The adjustable height drain of claim 1, wherein at least one break line is included within second interlocking elements wherein the height of the downwardly extending walls of the elongate drain element can be reduced to a predefined level.

11. The adjustable height drain of claim 1, wherein the elongate base element is constructed of plastic polymer or a metal.

12. The adjustable height drain of claim 1, wherein the elongate drain element is constructed of plastic polymer or a metal.

13. The adjustable height drain of claim 1, further comprising outwardly extending retention elements.

14. The adjustable height drain of claim 1, wherein the upwardly extending walls are parallel to and are laterally spaced from one another.

15. The adjustable height drain of claim 1, wherein the first interlocking elements are a plurality of longitudinal slots in the upwardly extending walls that extend the length of the elongate base element, and wherein the second interlocking elements are a plurality of longitudinal flanges extending from the downwardly extending walls, wherein one or more of said longitudinal slots are adapted to slidably engage one or more selected longitudinal flanges.

16. The adjustable height drain of claim 1, wherein at least one break line is included within first interlocking elements wherein the height of the upwardly extending walls can be reduced to a predefined level.

17. The adjustable height drain of claim 1, wherein at least one break line is included within second interlocking elements wherein the height of the downwardly extending walls of the elongate drain element can be reduced to a predefined level.

18. An adjustable height drain for a refurbished surface; wherein said refurbished surface includes individual units, the adjustable height drain comprising:

a. an elongate base element having walls extending upwardly from said elongate base element to form an interior water conducting channel;

b. a plurality of interlocking elements vertically spaced from each other on said upwardly extending walls;

c. an elongate drain element having a top surface supported by downwardly extending walls, said top surface having a plurality of apertures enabling water to drain through said top surface;

d. a plurality of interlocking elements vertically spaced from each other on said downwardly extending walls, wherein said elongate drain element comprising interlocking elements upon said downwardly extending walls is engaged upon said elongate base element via said interlocking elements depending from said upwardly extending walls such that said top surface of said elongate drain element is vertically spaced from said elongate base element by a first distance T(sub)1; and wherein said elongate drain element and said elongate base element may be subsequently disengaged and said first distance T(sub)1 adjusted to a second distance T(sub)N by altering which interlocking elements upon said downwardly extending walls of said elongate drain element are engaged upon said interlocking elements depending from said upwardly extending walls of said elongate base element.

19. A method for using an adjustable height drain comprising;

a. providing an adjustable height drain comprising;

i. an elongate base element having walls extending upwardly from said elongate base element to form an interior water conducting channel;

ii. a plurality of interlocking elements vertically spaced from each other on said upwardly extending walls;

iii. an elongate drain element having a top surface supported by downwardly extending walls, said top surface having a plurality of apertures enabling water to drain through said top surface;

iv. a plurality of interlocking elements vertically spaced from each other on said downwardly extending walls, b. determining a desired height of the final installed drain;

c. selecting said appropriate interlocking elements of said elongate base element and interlocking elements of said elongate drain element such that when said elongate base element and elongate drain element are engaged, said desired height is obtained;

d. engaging said elongate base element into elongate drain element; and e. installing the adjustable height drain having a said desired height so as to disperse water from a surface.

* * * * *